US006050714A

United States Patent [19]

Isabella

[11] Patent Number: 6,050,714

[45] Date of Patent: Apr. 18, 2000

[54] MUSICAL CHRISTMAS TREE HAVING ILLUMINABLE BRANCHES

[76] Inventor: Livio Isabella, 969 Moy Avenue, Windsor, Ontario, Canada, N9A 2N9

[21] Appl. No.: 09/131,926

[22] Filed: Aug. 10, 1998

[51] Int. Cl.[7] ..... F21P 3/00

[52] U.S. Cl. ..... 362/568; 362/123; 362/583

[58] Field of Search ..... 362/567, 568, 362/86, 122, 123, 253, 806, 293, 564, 583

[56] References Cited

U.S. PATENT DOCUMENTS

| | | | |
|---|---|---|---|
| 4,777,571 | 10/1988 | Morgan | 362/123 |
| 4,855,880 | 8/1989 | Mancusi, Jr. | 362/123 |
| 4,858,086 | 8/1989 | Pietrantonio et al. | 362/123 |
| 4,878,157 | 10/1989 | Koch | 362/123 |
| 4,980,608 | 12/1990 | Morrison | 362/806 |
| 5,213,407 | 5/1993 | Eisenbraun | 362/123 |
| 5,226,709 | 7/1993 | Labranche | 362/568 |
| 5,277,948 | 1/1994 | Daun | 428/7 |
| 5,455,750 | 10/1995 | Davis et al. | 362/123 |
| 5,517,390 | 5/1996 | Zins | 362/123 |
| 5,558,422 | 9/1996 | Sanford | 362/123 |
| 5,632,550 | 5/1997 | Yeh | 362/123 |
| 5,639,157 | 6/1997 | Yeh | 362/123 |
| 5,829,863 | 11/1998 | Gutshall | 362/123 |

*Primary Examiner*—Stephen Husar
*Attorney, Agent, or Firm*—Kenneth L. Tolar

[57] ABSTRACT

A Christmas tree having illuminable branches includes a hollow base component having an elongated trunk member vertically extending therefrom. A plurality of fiber optic cables are received within the trunk member and extend into the base component through which a lamp transmits light via a rotating color wheel. The lamp is in communication with a sound producing means and a circuit for varying the intensity of light according to the output of the sound producing means. Accordingly, the intensity of the illuminable tree varies according to the speed or volume of the music being produced by the integral sound producing means.

8 Claims, 4 Drawing Sheets

MUSICAL CHRISTMAS TREE HAVING ILLUMINABLE BRANCHES

BACKGROUND OF THE INVENTION

The present invention relates to a Christmas tree having illuminable branches, the intensity of which varies in synchronization with an integral music producing means.

DESCRIPTION OF THE PRIOR ART

Each Christmas season, many people erect Christmas trees and place various decorations and light strings thereon to enhance the appearance of the tree. The aesthetic effect and appearance of the tree is even further enhanced when the lights pulse or vary in intensity. However, attaching numerous light strands to a Christmas tree is time consuming and laborious. In addition, during the Christmas season, users are entertained by listening to Christmas carols while sitting around a Christmas tree. The present invention satisfies all of the above described needs by providing a Christmas tree having light producing branches which pulse or vary in intensity according to music produced by an integral sound chip.

Various Christmas trees and lighting devices therefor exist in the prior art. For example, U.S. Pat. No. 5,639,157 issued to Yeh relates to a decorative string lighting system.

U.S. Pat. No. 5,632,550 issued to Yeh relates to a decorative array lighting system comprising a wire harness having a plurality of circuit paths for feeding power to illuminators supported on a net member. The device also includes a control box having a miniature microphone therein which, when detecting music from an external source, causes the light array system to flash in synchronism with a music source.

U.S. Pat. No. 5,455,750 issued to Davis et al. relates to an artificial Christmas tree having a scent producing element therein as well as an illuminated tree-top ornament. Optionally, the arrangement may incorporate a sound producing means in the trunk body or tree support for producing holiday music.

U.S. Pat. No. 4,855,880 issued to Mancusi, Jr. relates to an electrically enhanced artificial tree.

U.S. Pat. No. 5,277,948 issued to Daun relates to an action ornament for use with decorative light string sets.

U.S. Pat. No. 4,980,608 issued to Morrison relates to an electric motor rotator for Christmas tree ornaments.

U.S. Pat. No. 5,226,709 issued to Labranche relates to a lighting arrangement for Christmas trees.

Although various lights and Christmas tree assemblies exist in the prior art, none relate to a Christmas tree according to the present invention having an integral sound producing means that varies the intensity of illuminable branches in synchronism therewith.

SUMMARY OF THE INVENTION

The present invention relates to an illuminable Christmas tree assembly. The device comprises a hollow base component having a motor means received therein. The motor means rotatably drives a shaft having a color wheel secured thereto. A high intensity lamp directs light through the rotating color wheel to transmit varying colored light to a plurality of illuminable branch members. Extending from the base component is a trunk member having a plurality of fiber optic tables received therein, the first ends of which are gathered and placed immediately above the rotating color wheel so that the light is transmitted therethrough. The second ends of the fiber optic cables are secured to a select one of a plurality of female receptacles disposed about the trunk member. The device also includes a plurality of branch members each having a plurality of fiber optic cables thereon, the ends of which protrude from an end of the branch to couple with the trunk member cables. Each branch member may be secured to a select connector on the trunk member to form an illuminable tree branch. Within the base component is a sound producing means in communication with circuitry for synchronously varying the intensity of the lighted branches according to the output of the sound producing means. It is therefore an object of the present invention to provide a Christmas tree having illuminable branches.

It is yet another object of the present invention to provide a Christmas tree having illuminable branches, the intensity of which vary according to the output of a sound producing means.

It is yet another object of the present invention to provide an illuminable Christmas tree which may be coupled with external music producing devices.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
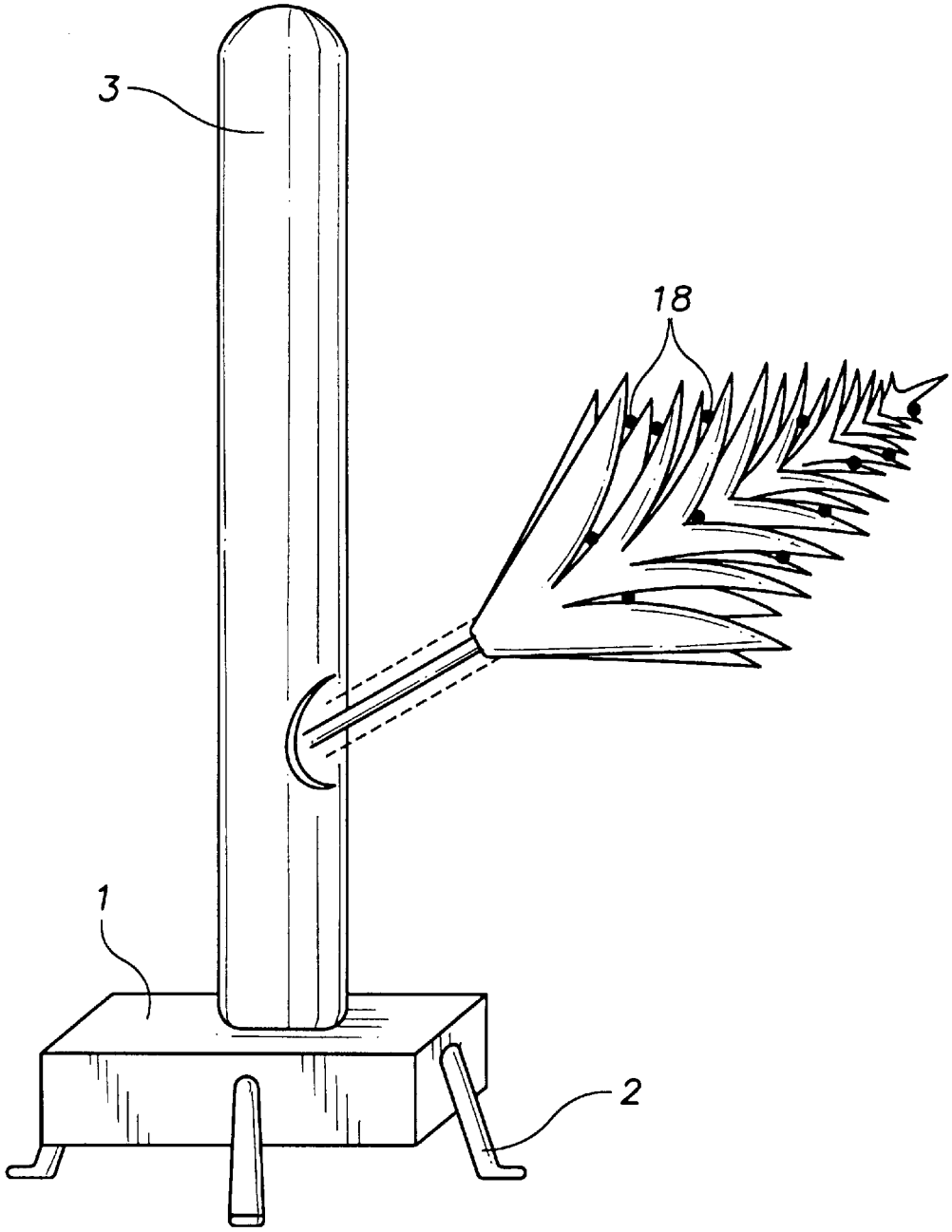
FIG. 1 is a perspective view of the inventive device.
Figure 2:
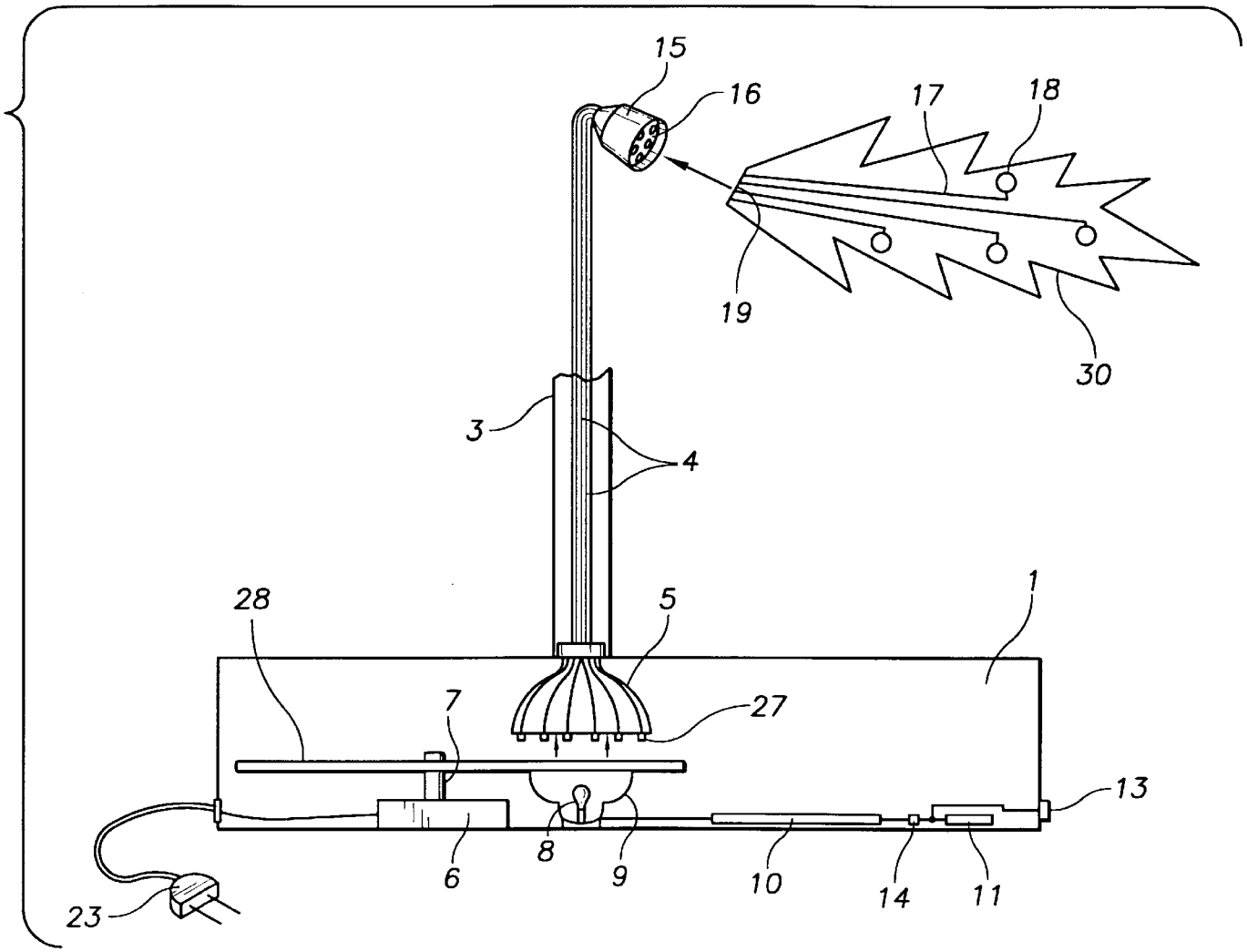
FIG. 2 is a side view of the base component depicting the internal components with the trunk member extending therefrom and a single branch member adjacent thereto.
Figure 3:
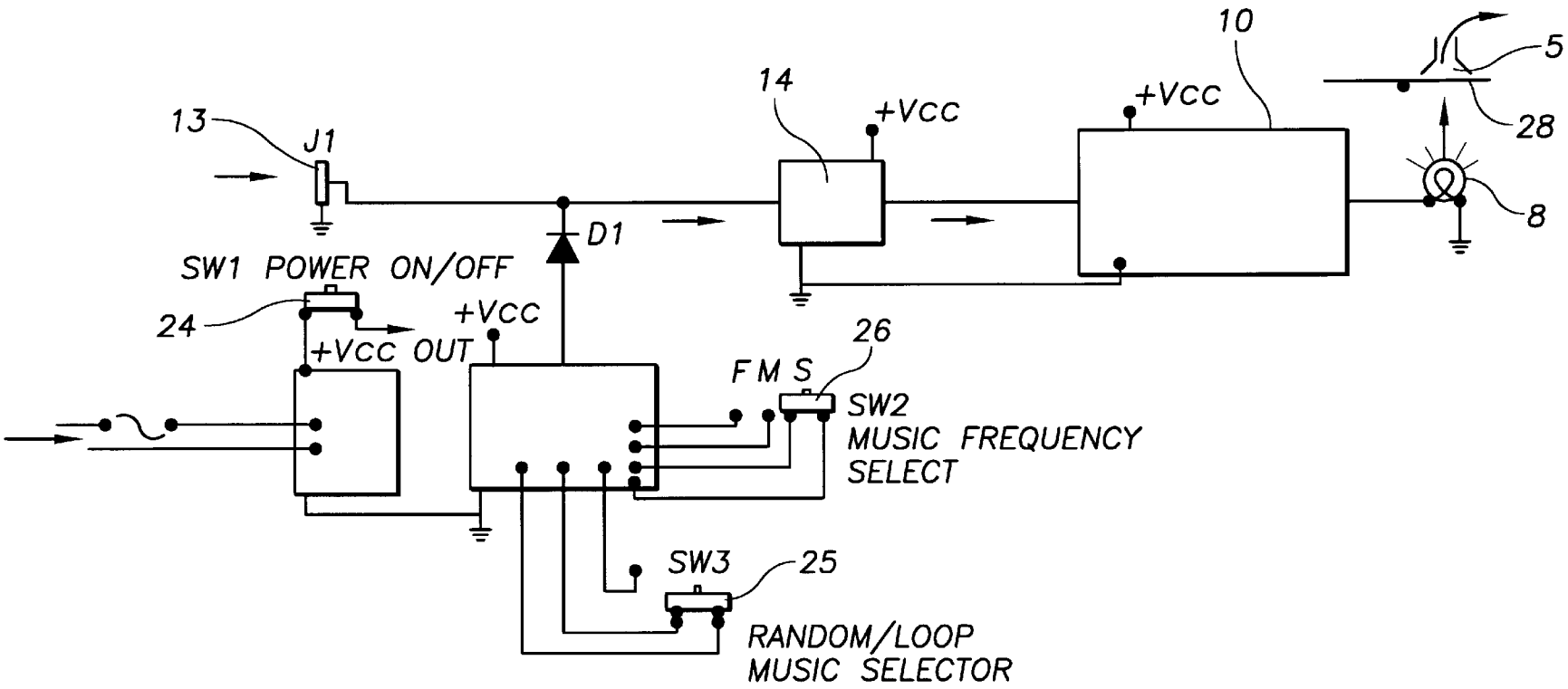
FIG. 3 depicts a schematic of the circuitry according to the present invention.

Referring now to FIGS. 1 through 4, the present invention relates to a Christmas tree having illuminable branches with an integral sound producing means that varies the light intensity synchronously with the output thereof. The device comprises a substantially hollow, box-type base component 1 having a top wall, a bottom wall and four side walls disposed therebetween. A plurality of leg members 2 are secured to the side walls for supporting the base component on a support surface. Vertically extending from the top wall of the base component is an elongated trunk member 3. A plurality of fiber optic cables 4 are received within the trunk member each having a first and second end with the first ends 27 radially grouped within an umbrella type housing 5 received within the base component.

Also received within the base component is a motor 6 that rotates a vertical drive shaft 7. Attached to the top distal end of the shaft is a color wheel 28, a portion of which is immediately below the fiber optic cable housing, that rotates when the motor is activated. The color wheel contains a plurality of juxtaposed, variably colored transparent portions for altering the color of light passing therethrough. Immediately below the color wheel is a high intensity lamp 8 for directing light through the color wheel. The lamp is received within a bowl shaped reflector 9 that directs light upwardly from the lamp toward the color wheel.

The high intensity lamp is in communication with a color organ circuit 10 which varies the intensity of the lamp according to the output of a sound producing means 11. The sound producing means is preferably a sound chip having a plurality of pre-recorded songs thereon. Alternatively, the sound producing means may relate to an external device 12 which may be electrically coupled with a color organ circuit board assembly 10 using an external jack 13 on a side of the base component. An amplifier or speaker 14 is also provided for audibilizing the output of the sound producing means.

The second ends of the various fiber optic cables are each routed to a select female receptacle 15 radially and longitudinally disposed about the trunk member. Within each receptacle are a plurality of ports 16 each coupled to a second end of a fiber optic cable. A plurality of branch members 30 are provided each having a plurality of fiber optic 17 cables therein. Each cable has a visible light producing portion 18 at a first end with the second end grouped within a distal portion 19 on the branch. The second ends of the branch fiber optic cables are dimensioned and spaced to be received within the receptacle ports when the distal portion of a branch is inserted into a trunk receptacle. Accordingly, each branch member may be secured to a select receptacle on the trunk, each of which will produce light of varying color upon the motor and lamp being activated.

Figure 4:
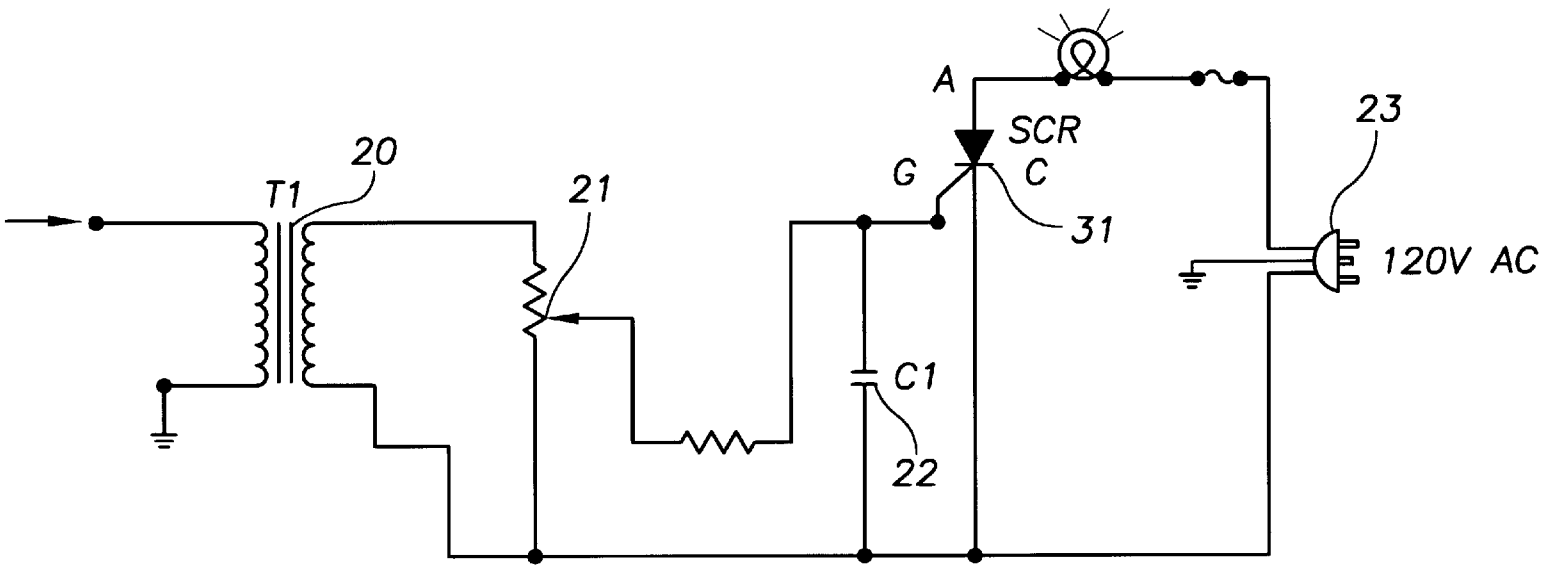
FIG. 4 depicts a schematic of the color organ circuit according to the present invention.

Referring now to FIGS. 4 and 5, the color organ circuit 10 for varying the lamp intensity is depicted in detail. An audio signal is transmitted from the digital sound chip to the circuit via a transformer 20. A variable resistor 21 delivers voltage to the gate of a silicon controlled rectifier (SCR) 31 which provides varying voltage to the output of the SCR. The resultant output is transmitted to the high intensity lamp. The variable resistor thus provides sensitivity control to the lamp in conjunction with a capacitor 22 according to the varying frequencies that are transmitted to the circuit. The SCR responds to a predetermined frequency depending upon the capacitance.

Power to the various components is provided via an electrical cord 23 and power switch 24. A mode switch 25 is also provided which allows for random or loop music selection from the digital sound chip as well as a frequency selection switch 26 that varies the speed of the sound producing means output.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A Christmas tree having illuminable branches comprising:

a hollow base component having an elongated trunk member vertically extending therefrom;

a plurality of light transmitting means received within said trunk member and extending into said base component;

a variable color light producing means received within said base component for transmitting light of varying colors through said light transmitting means;

a plurality of branch members removably attachable to said trunk member, each having a plurality of light emitting means thereon, said light emitting means in communication with said light producing means when said branches are attached to said trunk member;

a sound producing means received within said base component;

means for synchronously varying the output of said light producing means according to the output of said sound producing means.

2. A device according to claim 1 wherein said variable color light producing means comprises:

a motor means received within said base component;

a color wheel having an upper and lower surface and a plurality of variably colored translucent portions thereon, said wheel in mechanical communication with said motor means and rotatable thereby;

a light means immediately adjacent the lower surface of said color wheel for projecting light through said translucent portions.

3. A device according to claim 2 when said light transmitting means comprises:

a plurality of fiber optic cables each having first and second ends with a first end disposed immediately adjacent the upper surface of said color wheel, the second ends each in selective communication with a light emitting means on a branch member.

4. A device according to claim 1 wherein said means for varying the intensity of said light producing means comprises a circuit means in communication with said sound producing means and said light producing means for varying the intensity of said light producing means according to the output of said sound producing means.

5. A device according to claim 1 further comprising a receptacle on said base component in communication with said light intensity varying means for coupling an external sound producing means therewith.

6. A device according to claim 2 wherein said light means is received within a bowl shaped reflector for directing light produced by said light means upwardly through said color wheel.

7. A device according to claim 1 wherein said sound producing means is a digital, pre-recorded sound chip.

8. A device according to claim 1 wherein the output of said sound producing means is selectively variable.

* * * * *